US005499605A

United States Patent [19]

Thring

[11] Patent Number: 5,499,605

[45] Date of Patent: Mar. 19, 1996

[54] REGENERATIVE INTERNAL COMBUSTION ENGINE

[75] Inventor: Robert H. Thring, Devine, Tex.

[73] Assignee: Southwest Research Institute, San Antonio, Tex.

[21] Appl. No.: 403,204

[22] Filed: Mar. 13, 1995

[51] Int. Cl.[6] ..... F02B 43/08

[52] U.S. Cl. ..... 123/70 R; 123/298; 123/543

[58] Field of Search ..... 123/298, 543, 123/560, 70 R, 70 V

[56] References Cited

U.S. PATENT DOCUMENTS

| | | | |
|---|---|---|---|
| 2,058,705 | 10/1936 | Maniscalco | 123/70 V |
| 2,897,801 | 8/1959 | Kloss | 123/41.12 |
| 2,938,506 | 5/1960 | Buchi | 123/52 |
| 3,842,808 | 10/1974 | Cataldo | 123/25 P |
| 3,872,839 | 3/1975 | Russell et al. | 123/8.31 |
| 4,026,114 | 5/1977 | Belaire | 60/517 |
| 4,040,400 | 8/1977 | Kiener | 123/68 |
| 4,074,533 | 2/1978 | Stockton | 60/620 |
| 4,280,468 | 7/1981 | Millman | 123/546 |
| 4,284,055 | 8/1981 | Wakeman | 123/556 |
| 4,715,326 | 12/1987 | Thring | 123/3 |
| 4,781,155 | 11/1988 | Brücker | 123/70 |
| 4,790,284 | 12/1988 | Ferrenberg et al. | 123/543 |
| 4,928,658 | 5/1990 | Ferrenberg et al. | 123/543 |
| 5,050,570 | 9/1991 | Thring | 123/556 |
| 5,072,589 | 12/1991 | Schmitz | 60/622 |
| 5,085,179 | 2/1992 | Faulkner | 123/70 R |
| 5,228,415 | 7/1993 | Williams | 123/51 R |

*Primary Examiner*—David A. Okonsky
*Attorney, Agent, or Firm*—Baker & Botts

[57] ABSTRACT

A regenerative internal combustion engine (10) is provided that includes a regenerator (65) that is capable of preheating a charge of compressed air, while not causing premature combustion of fuel. The regenerator (65), in combination with a catalyst (75), also ignites residual amounts of combustible material in exhaust gases. The catalyst (75) itself is capable of oxidizing fuel in a combustion cylinder (50) once stable combustion is achieved.

28 Claims, 2 Drawing Sheets

REGENERATIVE INTERNAL COMBUSTION ENGINE

TECHNICAL FIELD OF THE INVENTION

This invention relates to multicylinder internal combustion engines, and more particularly to a multicylinder internal combustion engine with both a regenerator and a catalyst for enhanced fuel efficiency and reduced exhaust emissions.

BACKGROUND OF THE INVENTION

Today's internal combustion engines must meet difficult and sometimes conflicting requirements in order to be commercially successful. It is desirable that an internal combustion engine be efficient, perform well over a varied load, have good fuel economy, require only limited maintenance and emit little or no atmospheric pollution.

One requirement is that the engine be capable of using fuels other than gasoline or diesel. The fact is that petroleum based products are not renewable. Once society has consumed the earth's supply of oil, most conventional internal combustion engines will no longer to useful. Thus, there is a need for an internal combustion engine that burns alternative fuels.

Another demand is that the engine must also have a respectable power output. Even if it possesses all the other advantages mentioned herein, an engine that cannot generate power has no real commercial value.

Yet another demand is that engines be cleaner-burning. Concern with pollution due to exhaust fumes is more prevalent today than ever before. In order to curb such pollution, many laws have recently been enacted to regulate emissions. Moreover, the environmental movement has exerted increased pressure to clean up engine exhausts. Some existing engines offer a trade-off between low emissions of nitrogen oxide (NOX) and carbon monoxide (CO) and low emissions of hydrocarbons. For example, a stratified charge engine gives low emissions of NOX and CO because a spark ignites a mixture of air and fuel in a zone rich in fuel. The stratified charge engine, however, tends to have high emissions of unburned hydrocarbons because the combustion flame is quenched by the lean air/fuel ratio before all the fuel is burned. Other engines have attempted to address this concern. One regenerative, internal combustion engine is illustrated in U.S. Pat. No. 4,781,155 entitled *Regeneratively Acting Two-Stroke Internal Combustion Engine*, issued on Nov. 1, 1988 to H. G. Brucker. This engine includes a combustion cylinder and a supercharger cylinder, with the possibility of re-expanding combusted gases in the supercharger cylinder. This re-expansion improves pollutant emission.

Also in order to improve efficiency and power output, a compressed air-fuel mixture may be pre-heated before ignition. Preheating helps to optimize the combustion process within an engine, but preheating at too high a temperature may cause combustion prior to the desired moment when work can be effectively done on a piston. The mixture should not prematurely ignite during the preheating process. One type of multicylinder engine that provides for preheating is illustrated in U.S. Pat. No. 4,715,326 entitled *Multicylinder Catalytic Engine*, issued on Dec. 29, 1987 to R. H. Thring. This engine uses a heat exchanger for heating a mixture of compressed air and fuel using heat captured from the exhaust gases. Another type of internal combustion engine that provides for preheating is illustrated in U.S. Pat. No. 5,050,570 entitled *Open Cycle, Internal Combustion Stirling Engine*, issued on Apr. 5, 1989 to R. H. Thring. This engine uses a regenerator for heating compressed air using heat captured from exhaust gases. Both U.S. Pat. Nos. 4,715,326 and 5,050,570 are incorporated by reference for all purposes within this application.

SUMMARY OF THE INVENTION

In accordance with the present invention, a multicylinder internal combustion engine with both a regenerator and a catalyst is provided to substantially reduce or eliminate the disadvantages and problems associated with previous internal combustion engines.

One aspect of the present invention includes an internal combustion engine having a regenerator, ignition means, and a catalyst. When the engine is first started, the ignition means may initiate combustion or oxidation. After stable combustion is achieved, the ignition means may be turned off, and oxidation continued by the catalyst. For some applications this ignition means may be a spark plug and for other applications a glow plug. As will be explained later, the present invention provides an engine with no cetane or octane requirement. Thus, an engine incorporating the present invention could be an excellent choice for use with alternative fuels.

A technical advantage of the present invention includes providing an engine which intakes air from an external supply via an intake manifold. Since the present invention provides an air-breathing engine, the resulting engine output is comparable to conventional spark-ignition and diesel engines.

Another technical advantage of the present invention includes providing an engine with both a regenerator and a catalyst. The regenerator and the catalyst cooperate with each other to preheat and ignite the air/fuel mixture for optimum combustion or oxidation. The regenerator and the catalyst also cooperate with each other to further complete combustion of the exhaust gases and to transfer heat to the incoming air/fuel mixture. Exhaust gases leaving a combustion cylinder may contain uncombusted material that, if not burned, will be released into the atmosphere as pollution. The catalyst and the regenerator in the present invention serve to further oxidize any residual amounts of the air/fuel mixture in the exhaust gases. Therefore, the present invention creates less pollution than many other internal combustion engines.

Furthermore, the regenerator of the present invention, in combination with a fuel injector, is significant for another reason. The regenerator is capable of taking heat from the exhaust gas and preheating a compressed air charge before it reaches the combustion cylinder. The fuel injector adds fuel to the preheated compressed air only after the air has passed through the regenerator. Thus, the present invention is capable of recovering energy from hot exhaust gases and satisfactorily preheating a compressed air charge and mixing the air charge with fuel without prematurely igniting such mixture during preheating.

In one embodiment of the present invention, an open cycle regenerative internal combustion engine includes a compression cylinder with a compression piston reciprocating within such cylinder. A transfer manifold fluidly connects the compression cylinder to a combustion cylinder. A combustion piston reciprocates within the combustion cylinder. A regenerator is disposed within the transfer manifold. A catalyst is also disposed within the transfer manifold adjacent to the combustion cylinder. A fuel injector preferably dispenses fuel into the transfer manifold between the regenerator and the catalyst. A linkage connects the compression piston to the combustion piston. An initial ignition means ignites fuel in the combustion cylinder. An intake manifold is connected in fluid communication with the compression cylinder. An exhaust manifold is connected in fluid communication with the combustion cylinder. A plurality of valves control the flow of a charge of air throughout the engine.

In another embodiment of the present invention, a method for operating a regenerative internal combustion engine includes taking a charge of air from an external air supply into a compression cylinder. A compression piston compresses the charge of air within the compression cylinder. A transfer manifold transfers the compressed charge of air into a combustion cylinder. A regenerator disposed within the transfer manifold heats the compressed charge of air as it moves through the transfer manifold. A fuel injector adds fuel to the compressed charge of air. An initial ignition means ignites the mixture of compressed air and fuel within the combustion cylinder. Once stable combustion is achieved, a catalyst, disposed within the transfer manifold between the regenerator and the combustion cylinder, may be used to oxidize the mixture. The combustion of the mixture of compressed air and fuel performs work upon a combustion piston. A linkage, connected to the combustion piston and the compression piston, mechanically relates the motion of the combustion piston to the compression piston. An exhaust manifold connected to the transfer manifold exhausts gases from the combustion cylinder. The exhaust gases pass through the catalyst and the regenerator before entering the exhaust manifold. Both the regenerator and the catalyst enhance combustion or oxidation of exhaust gases leaving the combustion cylinder. The movement of the exhaust gases leaving the combustion cylinder through the regenerator heats the regenerator.

BRIEF DESCRIPTION OF THE DRAWINGS

For a more complete understanding of the present invention and for further advantages thereof, reference is now made to the following description taken in conjunction with the accompanying drawings, in which.

DETAILED DESCRIPTION OF THE INVENTION

Figure 1:
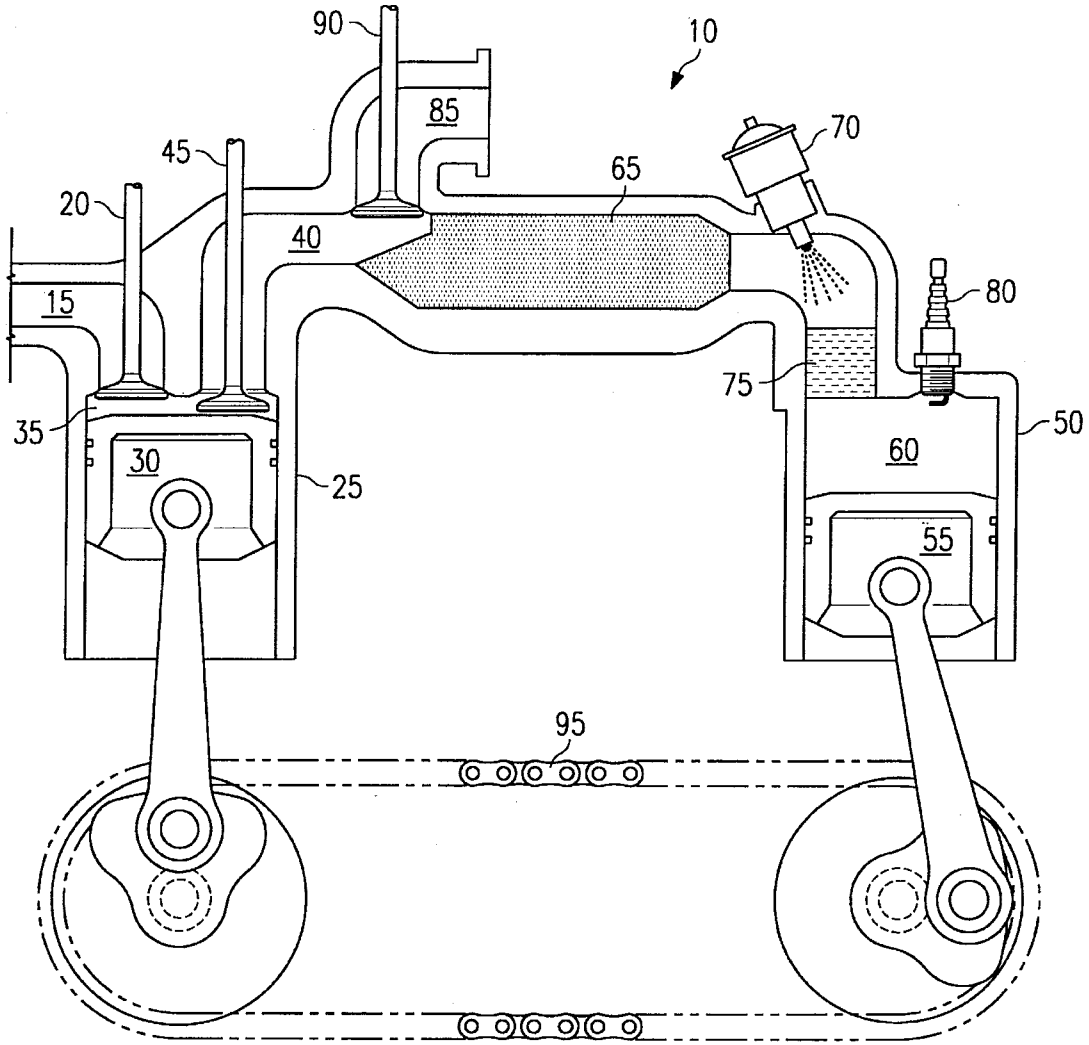
FIG. 1 illustrates a regenerative internal combustion engine incorporating an embodiment of the present invention having a spark plug to initially ignite fuel within a combustion cylinder, and using a chain drive to connect a compression piston to a combustion piston.
Figure 2:
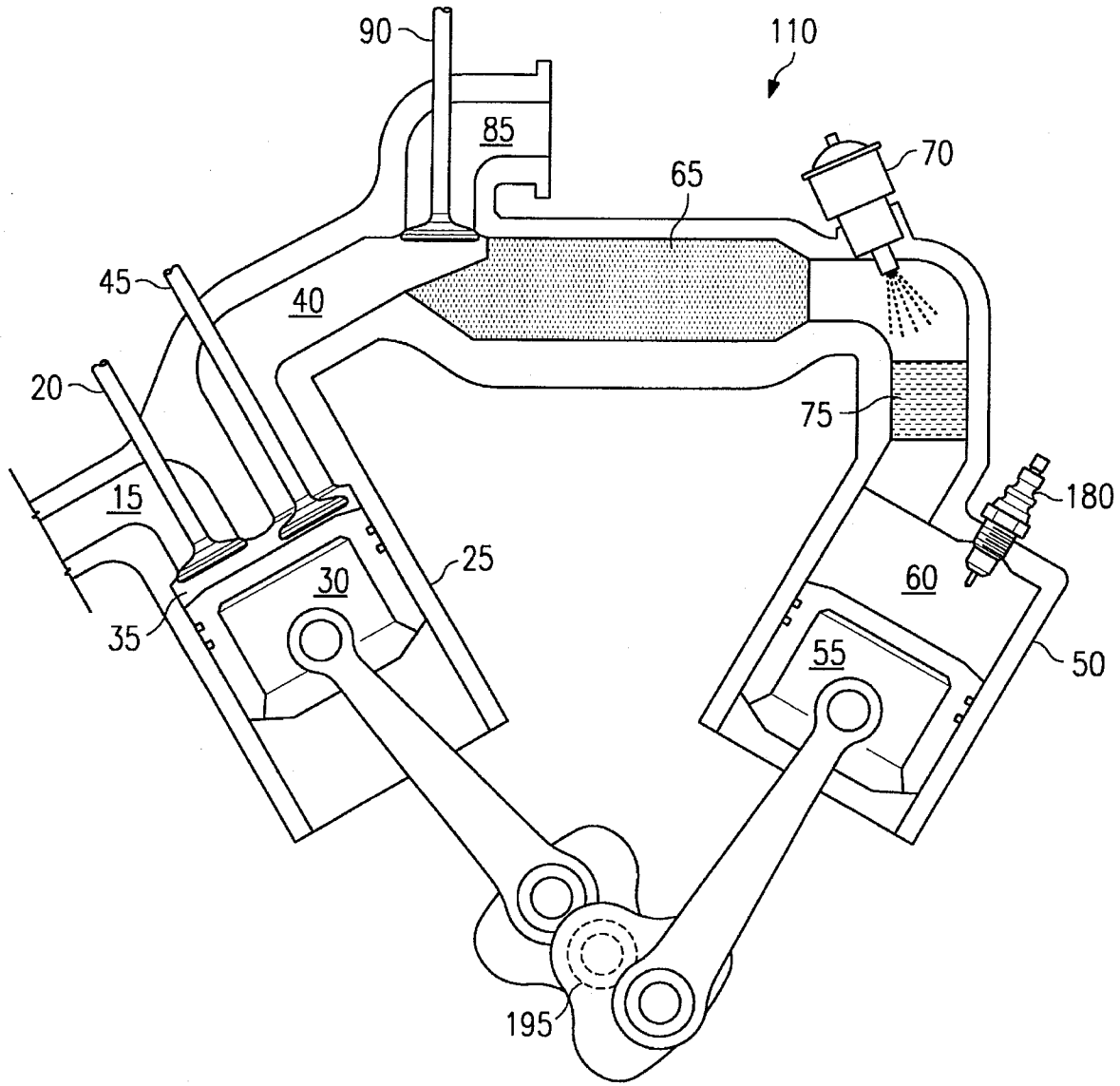
FIG. 2 illustrates a regenerative internal combustion engine incorporating an embodiment of the present invention having a glow plug to initially ignite fuel within a combustion cylinder, and using a crank shaft to connect a compression piston to a combustion piston.

The preferred embodiments of the present invention and its advantages are best understood by referring to FIGS. 1–2 of the drawings, like numerals being used for like and corresponding parts of the various drawings.

FIG. 1 illustrates a regenerative internal combustion engine 10 incorporating an embodiment of the present invention having a spark plug 80 to initially ignite fuel within a combustion cylinder 50, and using a chain drive 95 to connect a compression piston 30 to a combustion piston 55.

Compression piston 30 reciprocates within a compression cylinder 25 to define a variable volume cold space 35 contained within compression cylinder 25. Compression cylinder 25 includes an intake manifold 15 connected to the head of compression cylinder 25 and an intake valve 20 positioned in intake manifold 15 for opening and closing communication of intake manifold 15 with compression cylinder 25. Intake manifold 15 allows a charge of air from an external supply to enter cold space 35. Intake valve 20 is opened as compression piston 30 moves downward increasing cold space 35 and drawing the charge of air into compression cylinder 25 by way of intake manifold 15. One advantage of the present invention is that it generates a respectable power output. The present invention intakes air from an external supply. Because an engine incorporating the present invention is air-breathing, it will have a specific output comparable to conventional spark-ignition and diesel engines.

After intake valve 20 closes, compression piston 30 moves upward decreasing cold space 35 and compressing the charge of air within compression cylinder 25.

A transfer manifold 40 fluidly connects compression cylinder 25 and combustion cylinder 50, preferably between their heads. A transfer valve 45 is provided in transfer manifold 40, preferably in the head of compression cylinder 25, for opening and closing communication of transfer manifold 40 with compression cylinder 25. Transfer valve 45 is closed while the charge of air is drawn from the external supply into compression cylinder 25 by compression piston 30 and as compression piston 30 moves up to compress the charge of air. Transfer valve 45 is opened, just before compression piston 30 reaches top dead center, to allow the compressed charge of air to be transferred into transfer manifold 40. After the compressed charge of air leaves compression cylinder 25, transfer valve 45 closes.

For improving the thermal efficiency of engine 10, a regenerator 65 is disposed in transfer manifold 40 downstream of transfer valve 45. As the compressed charge of air moves through transfer manifold 40, regenerator 65 heats the charge of air. Regenerator 65 provides heat recovery at a high degree of efficiency, accompanied by considerable additional advantages. As will be more fully described hereinafter, a primary function of regenerator 65 is to absorb heat from hot exhaust gases flowing through it, and to impart such heat to cooler charges of compressed air flowing through transfer manifold 40 out of compression cylinder 25.

Fuel injector 70 dispenses fuel into the compressed charge of air in transfer manifold 40 after the charge has been heated by regenerator 65. An advantage of the present invention is that the compressed air/fuel mixture is preheated before it is ignited in combustion cylinder 50. Preheating helps to optimize the combustion process within engine 10. In other engines, preheating may cause problems because the air/fuel mixture prematurely ignites during the process. As will be explained later in more detail the arrangement of regenerator 65 and fuel injector 70, cooperating with each other in accordance with the teachings of the present invention, avoids problems of premature fuel ignition. Fuel injector 70 is disposed within transfer manifold 40 downstream from compression cylinder 25. Regenerator 65 may be formed from various materials such as metallic mesh, wool, ceramic monolith or beads and may contain platinum, rhodium or other suitable catalytic materials.

A catalyst 75 is disposed within transfer manifold 40 downstream of regenerator 65 in regards to the movement of the compressed charge of air. Catalyst 75 may be of any suitable form and material such as in the form of metallic mesh, wool, ceramic monolith, or beads, and may contain platinum, rhodium, or other suitable catalytic material. After fuel has been added to the compressed air charge by fuel injector 70, the pre-heated fuel-compressed air mixture passes through catalyst 75 before entering into combustion cylinder 50.

Combustion piston 55 reciprocates within combustion cylinder 50 to define a variable volume hot space 60 contained within combustion cylinder 50.

An advantage of the present invention is the capability of using fuels that are not petroleum based. In compression-ignition or diesel type engines, fuel is injected into highly compressed air and ignited by contact with the hot cylinder air after a short delay. If mixing of the fuel and air is too thorough by the end of the delay period, high rates of pressure rise result, and the operation of the engine is rough and noisy. A diesel engine, therefore, requires that fuel ignite quickly and spontaneously after injection. The cetane number of a particular fuel indicates its ability to ignite quickly after being injected into the cylinder of an engine. The present invention allows selecting the form and materials associated with regenerator 65 and catalyst 75 so that the fuel is not dependent upon compression ignition. Absent compression ignition, there is no delay period. Thus, the present invention has no cetane requirement.

In a spark ignition (e.g., gasoline) engine, combustion is initiated in the mixture of fuel and air by an electrical discharge. The resulting reaction moves across the combustion space as a zone of active burning, known as the flame front. If the flame front moves too slowly, the unburned mixture ahead of the flame may self-ignite, producing a strong pressure wave which causes combustion knock. A fuel of high octane number resists combustion knock principally because it has a longer self-ignition delay than other fuels under a given set of operating conditions. The present invention allows selecting the form and materials associated with regenerator 65 and catalyst 75 so that fuel is not oxidized in a flame front. Without a flame front, there can be no self-igniting of fuel ahead of the flame. Thus, the present invention has no octane requirement.

In the present invention, when engine 10 is first started, an ignition means, such as a spark plug 80, ignites the heated fuel-compressed air mixture causing combustion and expansion of the mixture. In another embodiment of the present invention, the ignition means could be a glow plug 180 (shown in FIG. 2). The burning, expanding combustion gases then flow into combustion cylinder 50 increasing hot space 60 and providing the working stroke for driving combustion piston 55 downward.

As soon as catalyst 75 has been sufficiently heated by the flow of exhaust gases leaving combustion cylinder 50, however, spark plug 80 or glow plug 180 may be turned off, because catalyst 75 will be sufficient to oxidize the heated fuel-compressed air mixture as it reaches hot space 60. Thus, because engine 10 has no cetane or octane requirement, it is an excellent candidate for use with alternative fuels.

Other internal combustion engines have used both an initiating means to cause combustion and a catalyst for oxidation. For example, the engine disclosed in U.S. Pat. No. 4,715,326 provides a spark plug in one cylinder for use during startup of the engine, and a catalyst in another cylinder once stable combustion is achieved. A significant difference between the present invention and the invention disclosed in U.S. Pat. No. 4,715,326 is that in the present invention, combustion occurs in the same cylinder both during startup and continued operation of engine 10.

An exhaust manifold 85, fluidly connected to transfer manifold 40, is provided for exhausting burned gases from combustion cylinder 50. Exhaust manifold 85 is disposed in such a way that exhaust gases leaving combustion cylinder 50 must first pass through catalyst 75 and regenerator 65. An exhaust valve 90, positioned in exhaust manifold 85, opens and closes communication of exhaust manifold 85 with transfer manifold 40. Exhaust valve 90 is closed during the power stroke, as combustion piston 55 moves downward within combustion cylinder 50 increasing hot space 60. Exhaust valve 90 opens after the end of the power stroke to allow upwardly moving combustion piston 55 to eject exhaust gases from combustion cylinder 50 into exhaust manifold 85 via transfer manifold 40, and consequently decrease hot space 60.

The exhaust gases leaving combustion cylinder 50 must pass through catalyst 75 and regenerator 65, both disposed within transfer manifold 40. The hot exhaust gases provide the desired heating for both catalyst 75 and regenerator 65 as the exhaust gases exit engine 10 by way of exhaust manifold 85.

As mentioned before, a primary function of regenerator 65 is to absorb heat from the hot exhaust gases flowing through it, and to impart such heat to cooler charges of compressed air flowing through transfer manifold 40 out of compression cylinder 25. Thus, the waste heat from the exhaust gases is applied to the compressed air charge in transfer manifold 40 before combustion occurs by action of catalyst 75 within combustion cylinder 50. Regenerator 65 should not impede gas flow, and can take a number of forms consistent with the above requirements. Regenerator 65 may be formed from metal mesh or coiled metal wire, the choice of metal being determined by the nature of gases to which regenerator 65 will be exposed. Regenerator 65 may also be formed from a honeycomb of ceramic material. In some respects, ceramic materials may be better because of their greater tolerance for high temperatures and corrosive atmospheres.

Another advantage of the present invention is that engine 10 has low emissions of nitrogen oxide (NOX), carbon monoxide (CO), and hydrocarbons. As the exhaust gases leave combustion cylinder 50, the gases do not immediately exit engine 10. Rather, the exhaust gases must pass through catalyst 75 and regenerator 65 before entering exhaust manifold 85. Catalyst 75 will enhance further combustion or oxidation of any unburned hydrocarbons and CO in the exhaust gases. Regenerator 65 may be formed from suitable catalytic material to perform the same function. Also, if engine 10 operates at a stoichiometric air-fuel ratio, catalyst 75 and regenerator 65 reduces NOX emissions. Thus, both catalyst 75 and regenerator 65 may act as exhaust thermal reactors to remove undesired emissions.

Other internal combustion engines have used catalysts to clean up hydrocarbon emissions. Often, the catalyst is disposed within the exhaust system. U.S. Pat. No. 4,715,326 provides a catalyst disposed within a transfer passageway connecting a first cylinder to a second cylinder. However, the catalyst in U.S. Pat. No. 4,715,326 does not act upon exhaust gases. The present invention routes both the air/fuel mixture and exhaust gases through the same catalyst 75.

Important technical advantages of the present invention include the ability to select the location, design, and type of materials associated with catalyst 75 and regenerator 65. Since catalyst 75 is located immediately adjacent to combustion cylinder 50, exhaust gases will typically heat catalyst 75 to a higher temperature than the temperature of regenerator 65. Thus, for some applications catalyst 75 may be formed from materials which will further enhance the combustion or oxidation of any residual fuel contained in the exhaust gases. Regenerator 65 may be designed and formed from materials to optimize the transfer of heat energy from the exhaust gases. For other applications the location, material and design associated with catalyst 75 and regenerator 65 may be varied to allow further combustion or oxidation of residual fuel in both catalyst 75 and regenerator 65. The specific types of material and the construction associated with regenerator 65 and catalyst 75 will depend upon the fuel used to power engine 10 and the type of exhaust gases produced within combustion cylinder 50.

Combustion piston 55 and compression piston 30 are timed with any suitable actuation linkage, such as chain drive 95, so that combustion piston 55 leads compression piston 30 by a crank angle of 45 to 90 degrees, preferably 70 degrees. In another embodiment of the present invention, the linkage could be a crank shaft 195 (shown in FIG. 2). Intake valve 20, transfer valve 45, and exhaust valve 90 may be timed by chain drive 95 and any suitable valve mechanism to coordinate their movements with combustion piston 55 and compression piston 30 as described above.

FIG. 2 illustrates a regenerative internal combustion engine 110 incorporating an embodiment of the present invention having a glow plug 180 to initially ignite fuel within combustion cylinder 50, and using a crank shaft 195 to connect compression piston 30 to combustion piston 195. Aside from the use of glow plug 180 and crank shaft 195, the operation of this embodiment of the present invention is substantially the same as for the embodiment shown in FIG. 1.

The method of the present invention is apparent from the foregoing description of the structure and operation of engine 10. The method of operating a regenerative internal combustion engine having a compression cylinder with a compression piston reciprocating therein and a combustion cylinder with a combustion piston reciprocating therein comprises intaking a charge of air from an external air supply into the compression cylinder and compressing the charge of air within the combustion cylinder. The method further comprises transferring the compressed charge of air into the combustion cylinder via a transfer manifold, heating the charge by use of a regenerator disposed within the transfer manifold, and adding fuel to the compressed charge by use of a fuel injector. The method also comprises igniting the mixture of compressed air and fuel within the combustion cylinder by use of an initial ignition plug and then oxidizing the mixture by use of a catalyst once stable combustion is achieved, the combustion operable to perform work upon the combustion piston. The method further comprises enhancing combustion of exhaust gases leaving the combustion cylinder by use of both the regenerator and the catalyst, exhausting the exhaust gases from the combustion cylinder via an exhaust manifold connected to the transfer manifold, and heating the regenerator and the catalyst by forcing exhaust gases from the combustion cylinder through the regenerator and the catalyst. The method also comprises mechanically relating the motion of the combustion piston with motion of the compression piston by use of a linkage.

The present invention, therefore, is well adapted to carry out the objects and attain the ends and advantages mentioned as well as others inherent therein. Although the present invention has been described with several embodiments, various changes and modifications may be suggested to one skilled in the art, and it is intended that the present invention encompass such changes and modifications as fall within the scope of the appended claims.

What is claimed is:

1. An open cycle regenerative internal combustion engine, comprising:

a compression cylinder with a compression piston reciprocating therein;

a combustion cylinder with a combustion piston reciprocating therein;

an intake manifold connected in fluid communication with the compression cylinder and an exhaust manifold connected in fluid communication with the combustion cylinder;

the compression cylinder and the compression piston are operable to compress a charge of air admitted into the engine by the intake manifold;

a transfer manifold connected in fluid communication between the compression cylinder and the combustion cylinder;

a regenerator disposed in the transfer manifold;

a catalyst disposed in the transfer manifold adjacent the combustion cylinder;

a fuel injector operable to dispense fuel into the transfer manifold between the regenerator and the catalyst;

a linkage connecting the compression piston to the combustion piston;

an ignition means for igniting fuel within the combustion cylinder; and a plurality of valves operable to control the flow of a charge of air throughout the engine.

2. The engine of claim 1, wherein the ignition means comprises a spark plug.

3. The engine of claim 1, wherein the ignition means comprises a glow plug.

4. The engine of claim 1, wherein the catalyst is operable to oxidize fuel within the combustion cylinder and the catalyst further operable to complete oxidation of exhaust gases leaving the combustion cylinder.

5. The engine of claim 1, wherein the transfer manifold is operable to transfer a charge of air from the compression cylinder to the combustion cylinder and the transfer manifold further operable to transfer exhaust gases from the combustion cylinder into the exhaust manifold.

6. The engine of claim 1, wherein the regenerator is operable to heat a charge of air that moves through the regenerator from the compression cylinder into the combustion cylinder and the regenerator further operable to absorb heat from exhaust gases that exit the combustion cylinder.

7. The engine of claim 1, wherein the regenerator is operable to complete oxidation of exhaust gases leaving the combustion cylinder.

8. The engine of claim 1, wherein the linkage is operable to mechanically relate reciprocation of the compression piston with reciprocation of the combustion piston.

9. The engine of claim 1 further comprising:

a transfer valve to control the flow of compressed air from the compression cylinder into the transfer manifold; and an exhaust valve to control the flow of exhaust gases from the regenerator into the exhaust manifold.

10. The engine of claim 1, further comprising:

an intake valve operable to control a flow of air from the intake manifold into the compression cylinder;

a transfer valve operable to control the flow of air from the compression cylinder into the transfer manifold; and an exhaust valve operable to control a flow of exhaust gases from the transfer manifold into the exhaust manifold.

11. The engine of claim 1, wherein the linkage comprises a chain drive.

12. The engine of claim 1, wherein the linkage comprises a crank shaft.

13. The engine of claim 1, wherein the catalyst comprises material selected from the group consisting of cesium, platinum, and rhodium.

14. The engine of claim 1, wherein the catalyst comprises a form selected from the group consisting of metallic mesh, wool, ceramic monolith, and beads.

15. The engine of claim 1, wherein the regenerator comprises of a form selected from the group consisting of metal mesh, coiled metal wire, and ceramic honeycomb.

16. A multicylinder, regenerative internal combustion engine, comprising:

a first cylinder and a first piston reciprocating therein, the first piston defining in part a variable volume cold space within the first cylinder, the first piston operable to compress a charge of air within the first cylinder;

a second cylinder and a second piston reciprocating therein, the second piston defining in part a variable volume hot space within the second cylinder;

an intake manifold connected to the first cylinder, the intake manifold operable to allow the charge of air to enter the cold space, the intake manifold in communication with a supply of air;

an intake valve positioned in the intake manifold, the intake valve operable to control flow of the charge of air from the intake manifold to the cold space;

a transfer manifold connecting the first cylinder with the second cylinder, the transfer manifold operable to allow the charge of air to move from the cold space to the hot space, the transfer manifold further operable to allow exhaust gases to leave the hot space;

a transfer valve positioned in the transfer manifold, the transfer valve operable to control the flow of air from the cold space into the transfer manifold;

a regenerator disposed in the transfer manifold, the regenerator operable to heat the charge of air as it moves from the cold space to the hot space, the regenerator further operable to remove heat from exhaust gases leaving the hot space;

a catalyst disposed in the transfer manifold adjacent to the second cylinder, the catalyst operable to oxidize fuel entering the hot space, the catalyst further operable to enhance oxidation of exhaust gases leaving the hot space;

a fuel injector operable to dispense fuel into the transfer manifold between the regenerator and the catalyst;

an ignition means operable to cause combustion in the hot space of the second cylinder;

a linkage connecting the first piston to the second piston, the linkage operable to mechanically relate reciprocation of the first piston with reciprocation of the second piston;

an exhaust manifold connected to the transfer manifold, the exhaust manifold operable to allow the exhaust gases to exit the transfer manifold; and an exhaust valve positioned in the exhaust manifold, the exhaust valve operable to control the flow of exhaust gases from the transfer manifold to the exhaust manifold.

17. The engine of claim 16, wherein the linkage connecting the first piston to the second piston comprises a chain drive.

18. The engine of claim 16, wherein the linkage connecting the first piston to the second piston comprises a crank shaft.

19. The engine of claim 16, wherein the catalyst comprises material selected from the group consisting of cesium, platinum, and rhodium.

20. The engine of claim 16, wherein the catalyst comprises a form selected from the group consisting of metallic mesh, wool, ceramic monolith, and beads.

21. The engine of claim 16, wherein the regenerator comprises a form selected from the group consisting of metal mesh, coiled metal wire, and ceramic honeycomb.

22. The engine of claim 16, wherein the ignition means comprises a spark plug.

23. The engine of claim 16, wherein the ignition means comprises a glow plug.

24. A method for operating a regenerative internal combustion engine, comprising:

intaking a charge of air from an external air supply into a compression cylinder;

compressing the charge of air within the compression cylinder by use of a compression piston;

transferring the compressed charge of air into a combustion cylinder via a transfer manifold;

heating the compressed charge of air by use of a regenerator disposed within the transfer manifold;

adding fuel to the compressed charge of air by use of a fuel injector after the compressed charge of air has been heated by the regenerator;

igniting the mixture of compressed air and fuel within the combustion cylinder by use of an initial ignition means and then oxidizing the mixture by use of a catalyst once stable combustion is achieved to perform work upon a combustion piston;

exhausting exhaust gases from the combustion cylinder via an exhaust manifold connected to the transfer manifold;

heating the regenerator and the catalyst by exhaust gases flowing from the combustion cylinder through the regenerator and the catalyst;

enhancing oxidation of exhaust gases leaving the combustion cylinder by use of the catalyst; and mechanically relating motion of the combustion piston with motion of the compression piston by use of a linkage.

25. The method of claim 24, further comprising the steps of reducing exhaust gas emissions by cooperation of the regenerator with the catalyst.

26. The method of claim 24, further comprising the steps of:

controlling flow of the charge of air from the external air supply into the compression cylinder with an intake valve;

controlling flow of the charge of air from the compression cylinder into the transfer manifold with a transfer valve; and controlling flow of the exhaust gases from the combustion cylinder with an exhaust valve.

27. The method of claim 24, further comprising the step of initiating combustion with a spark plug.

28. The method of claim 24, further comprising the step of initiating combustion with a glow plug.

* * * * *